US007458895B2

(12) United States Patent
Tastad et al.

(10) Patent No.: US 7,458,895 B2
(45) Date of Patent: Dec. 2, 2008

(54) FLOATING BEZEL FOR A PERIPHERAL COMPONENT IN A GAMING MACHINE

(75) Inventors: Gregory J. Tastad, Kenosha, WI (US); Norman R. Wurz, Des Plaines, IL (US)

(73) Assignee: WMS Gaming Inc., Waukegan, IL (US)

( * ) Notice: Subject to any disclaimer, the term of this patent is extended or adjusted under 35 U.S.C. 154(b) by 725 days.

(21) Appl. No.: 10/242,224

(22) Filed: Sep. 12, 2002

(65) Prior Publication Data

US 2004/0053698 A1 Mar. 18, 2004

(51) Int. Cl.
*A63F 9/24* (2006.01)
*G07F 1/00* (2006.01)

(52) U.S. Cl. ..... 463/46; 463/47; 194/206; 194/344; 194/350; 235/380

(58) Field of Classification Search ..... 194/344–353, 194/206, 293, 296; 271/46, 65, 292; 101/66; 463/46; 312/348.4, 271; 198/350; 273/143 R
See application file for complete search history.

(56) References Cited

U.S. PATENT DOCUMENTS 4,760,457 A * 7/1988 Demers et al. ..... 348/826
4,795,155 A * 1/1989 Grande ..... 273/143 R
5,013,106 A * 5/1991 Twellmann ..... 312/330.1
5,084,757 A * 1/1992 Leo et al. ..... 348/825
5,544,728 A * 8/1996 Dabrowski ..... 194/206
5,635,696 A * 6/1997 Dabrowski ..... 235/449
5,757,617 A * 5/1998 Sherry ..... 361/685
5,791,449 A * 8/1998 Deaville et al. ..... 194/348
5,955,718 A * 9/1999 Levasseur et al. ..... 235/381
5,967,287 A * 10/1999 Cole ..... 194/344
5,993,317 A * 11/1999 Majima ..... 463/29
6,019,207 A * 2/2000 Cole ..... 194/206
6,216,999 B1 * 4/2001 Olson et al. ..... 248/694
6,276,769 B1 * 8/2001 Wortman ..... 312/114
6,283,268 B1 * 9/2001 Fletcher et al. ..... 194/344
6,651,797 B1 * 11/2003 Tree ..... 194/352

* cited by examiner

*Primary Examiner*—M. Sager
(74) *Attorney, Agent, or Firm*—Nixon Peabody LLP

(57) ABSTRACT

A peripheral component arrangement for a gaming machine comprises a peripheral component and a floating bezel. The peripheral component is mounted within a housing of the gaming machine and includes an entry end with an entry slot. The bezel is floatably mounted to a front door of the housing and is mated to the entry end of the peripheral component when the front door is closed. Because the bezel is floatably mounted to the front door, the bezel can shift relative to the front door so as to align with and properly mate to the entry end of the peripheral component.

22 Claims, 2 Drawing Sheets

FLOATING BEZEL FOR A PERIPHERAL COMPONENT IN A GAMING MACHINE

FIELD OF THE INVENTION

The present invention relates generally to gaming machines and, more particularly, to a floating bezel for a peripheral component in a gaming machine.

BACKGROUND OF THE INVENTION

Many gaming machines contain a bill acceptor (i.e., bill validator) that draws in and reads currency bills inserted therein by a player. The bill acceptor includes an entry end with an entry slot for receiving the inserted bills. If an inserted bill is determined to be valid, the bill acceptor accepts the bill and delivers it to a cassette that stores the accepted bills. If, however, an inserted bill is determined to be invalid, the bill acceptor rejects the bill by dispensing it from the bill acceptor. The gaming machine increments its credit meter by a number of credits corresponding to the value of an accepted bill. For example, on a "quarter" machine where each wagered credit is worth one quarter, the gaming machine increments its credit meter by four credits for each accepted dollar bill, by twenty credits for each accepted five dollar bill, by forty credits for each accepted ten dollar bill, and so on.

A bill acceptor is mounted inside a housing of the gaming machine at a mounting location. The housing includes a front door having an opening that exposes the entry slot at the entry end of the bill acceptor. In some assemblies, the bill acceptor may be mounted so deep within the machine housing that a gap exists between the front door and the entry end of the bill acceptor. To bridge this gap, a separate bezel is fixedly mounted to the front door and extends between the front door and the entry end of the bill acceptor when the door is closed.

A drawback of the above assembly is that the bezel and the entry end of the bill acceptor may be misaligned or become misaligned. Such misalignment may be caused by such factors as variances in manufacturing, age, environmental conditions, shipping and handling, etc. If the bezel and the entry end of the bill acceptor are misaligned, the entry slot may be partially concealed and thereby interfere with a player's ability to insert bills into the entry slot. In addition, the entry end of the bill acceptor includes certain visual status indicators such as miniature LED's indicative of the bill acceptor's operating state, e.g., functioning properly, malfunctioning, full bill cassette, etc. The bezel includes one or more transmissive windows that normally reveal the status indicators when the bezel and the entry end are aligned. If the bezel and the entry end are misaligned, the status indicators might be partially concealed and thereby interfere with a person's ability to easily detect the operating state of the bill acceptor. To cure any misalignment between the bezel and the entry end of the bill acceptor, the position of the front door, bezel, and/or the bill acceptor may require manual adjustment.

SUMMARY OF THE INVENTION

In accordance with the present invention, a peripheral component arrangement for a gaming machine comprises a peripheral component and a floating bezel. The peripheral component is mounted within a housing of the gaming machine and includes an entry end with an entry slot. The bezel is floatably mounted to a front door of the housing and is mated to the entry end of the peripheral component when the front door is closed. Because the bezel is floatably mounted to the front door, the bezel can shift relative to the front door so as to align with and properly mate to the entry end of the peripheral component. The alignment of the bezel relative to the entry end of the peripheral component ensures that the entry slot is fully exposed for receiving or dispensing bills, tickets, coupons, vouchers, cards, or the like and that any status indicators on the entry end are visible through the bezel.

BRIEF DESCRIPTION OF THE DRAWINGS

The foregoing and other advantages of the invention will become apparent upon reading the following detailed description and upon reference to the drawings.

Figure 1:
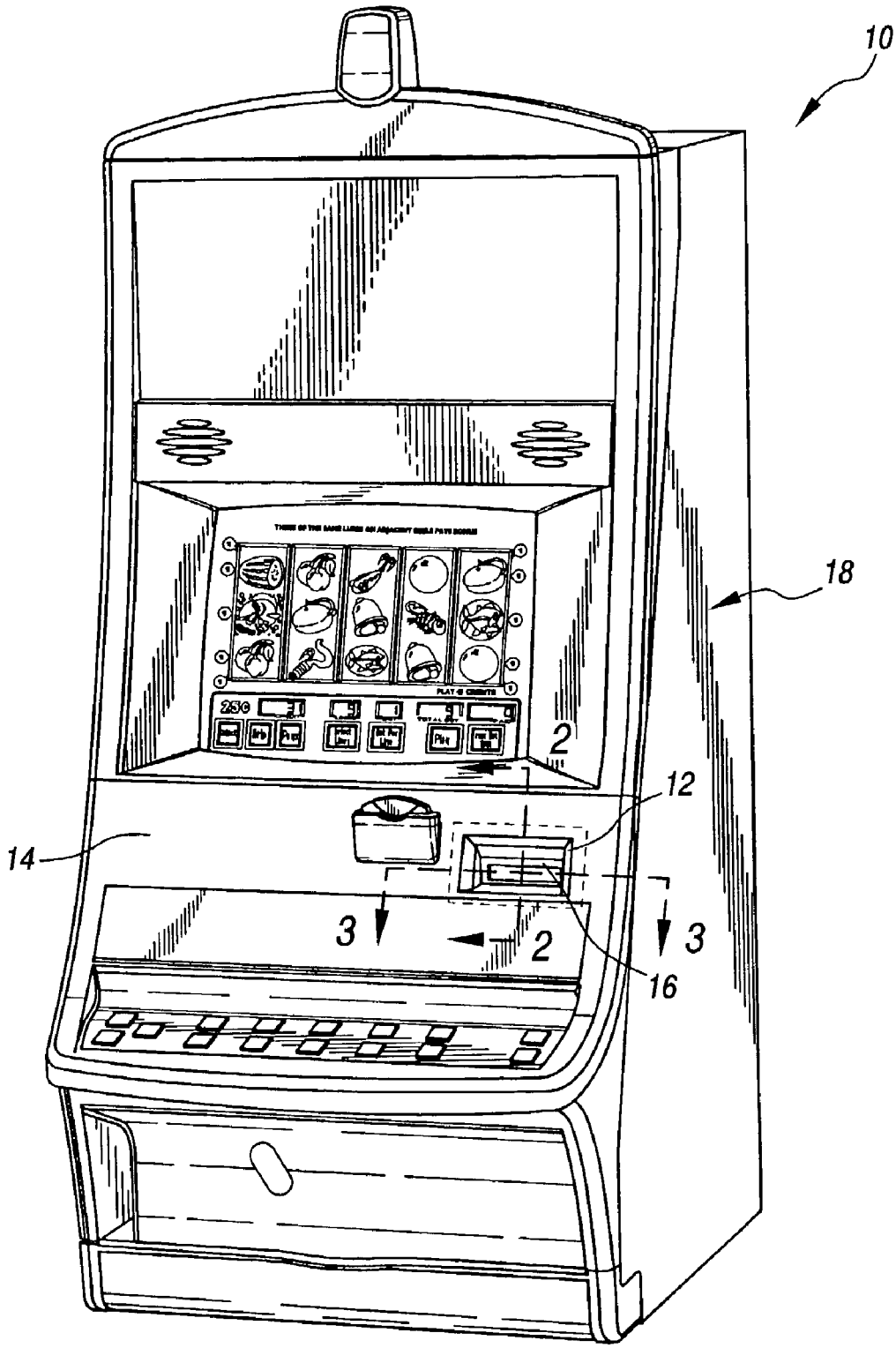
FIG. 1 is an isometric view of a gaming machine containing a bill acceptor arrangement having a floating bezel and a bill acceptor.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENT

Referring now to the drawings, FIG. 1 depicts a gaming machine 10 containing a peripheral component arrangement embodying the present invention. In the illustrated example, the peripheral component arrangement is a bill acceptor arrangement having a floating bezel 12 and a bill acceptor 16. It should, however, be understood that the floating bezel 12 may interface with other peripheral components of a gaming machine that require a separate bezel for receiving or dispensing tickets, coupons, vouchers, cards, or the like. Examples of such other peripheral components include a printer, a card reader, and a ticket or coupon acceptor/dispenser. The gaming machine 10 further includes a hinged front door 14 that may be unlocked with a suitable key and opened by service personnel.

Figure 2:
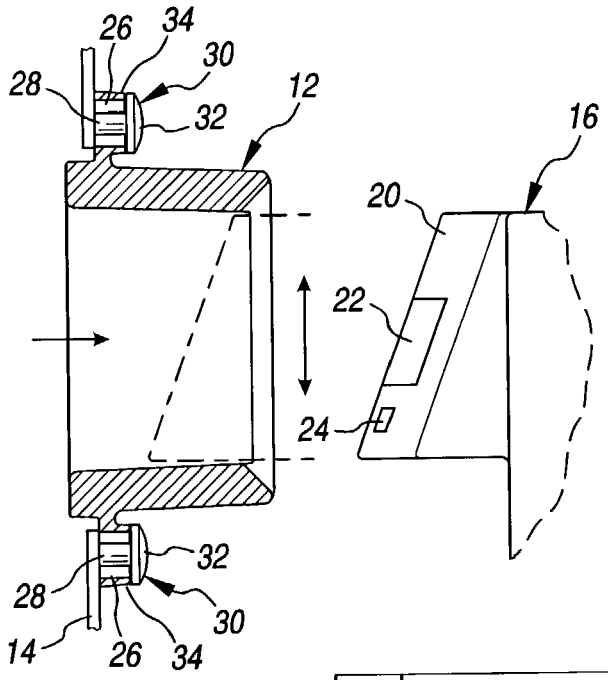
FIG. 2 is a section taken generally along line 2-2 in FIG. 1, showing how the floating bezel mates to an entry end of the bill acceptor.
Figure 3:
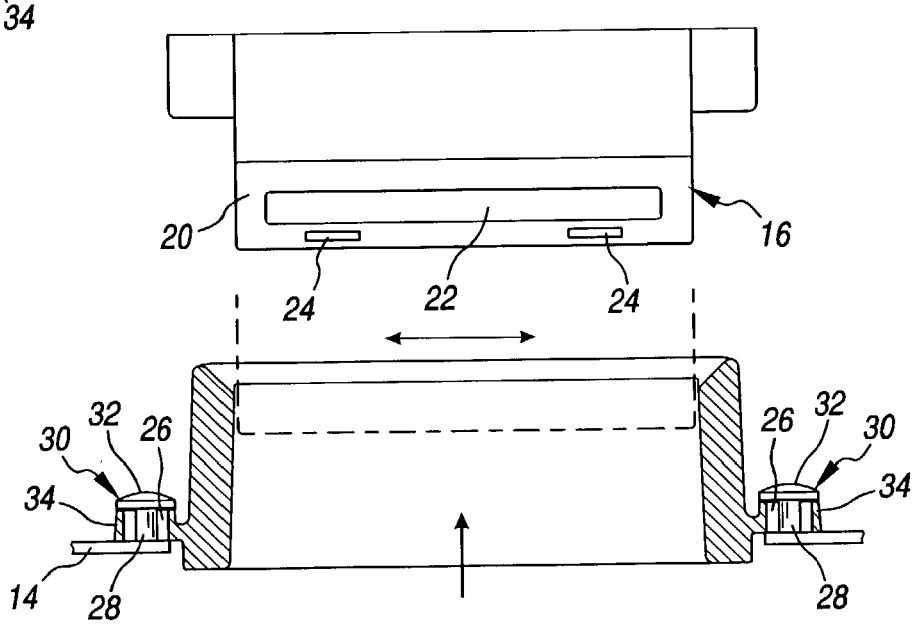
FIG. 3 is a section taken generally along line 3-3 in FIG. 1, showing how the floating bezel mates to the entry end of the bill acceptor.

FIGS. 2 and 3 are cross-sectional views of the bill acceptor arrangement. The bill acceptor 16 is mounted within a housing 18 (see FIG. 1) of the gaming machine and includes an entry end 20 with an entry slot 22. The bill acceptor 16 may be implemented with a WBA Series World Bill Acceptor commercially available, for example, from JCM American Corporation of Las Vegas, Nev. Alternatively, the bill acceptor 16 may be implemented with a ZT Series 1000Bill Acceptor commercially available from Mars Electronics International (MED of West Chester, Penn.

The bezel 12 is floatably mounted to the front door 14 of the housing 18 and mated to the entry end 20 of the bill acceptor 16 when the front door 14 is closed. Because the bezel 12 is floatably mounted to the front door 14, the bezel 12 can shift relative to the front door 14 so as to align with and properly mate to the entry end 20 of the bill acceptor 16.

The bezel 12 is floatably mounted to the front door 14 by a pair of fasteners 30. Each fastener 30 extends loosely through a respective first aperture 26 in the bezel 12 and is fixed within (e.g., by threading if the fastener 30 is screw) a respective second aperture 28 in the front door 14. The second aperture 28 is generally in line with and smaller than the first aperture 26. The fastener 30 is preferably a screw, bolt, or the like having a large head 32. The large head 32 rests either on a wall or shoulder 34 encompassing the aperture 26 or on an intervening washer that, in turns, rests on the shoulder 34.

Figure 4:
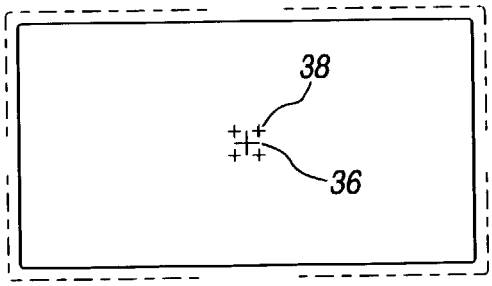
FIG. 4 is a diagram showing the extent of "float" of the floating bezel relative to the bill acceptor.

The aperture 26 is sufficiently larger than the body of fastener 30 to allow the bezel 12 to shift relative to the front door 14 by approximately one-eighth inch in any direction from an unshifted center position. Referring to FIG. 4, in the unshifted center position 36, each fastener 30 in FIGS. 2 and 3 is centered relative to the respective aperture 26 in the bezel 12, and a radial distance between each fastener 30 and an inner wall 34 encompassing the respective aperture 26 is one-eighth inch. In a fully shifted off-center position 38, each fastener 30 in FIGS. 2 and 3 abuts the inner wall 34 encompassing the respective aperture 26.

Because the bezel 12 is floatably mounted to the front door 14, the bezel 12 can shift relative to the front door 14 so as to align with and properly mate to the entry end 20 of the bill acceptor 16. The alignment of the bezel 12 relative to the entry end 20 of the bill acceptor 16 ensures that the entry slot 22 is fully exposed for receiving bills and that any status indicators 24 on the entry end 20 are visible through corresponding windows in the bezel 12. The status indicators 24 may be miniature LED's and/or character-based displays indicative of the bill acceptor's operating state, e.g., functioning properly, malfunctioning, full bill cassette, etc.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims:

What is claimed is:

1. A peripheral component arrangement for a gaming machine including a housing, the peripheral component arrangement comprising:

a peripheral component mounted within the housing and including an entry end with an entry slot; and a bezel floatably mounted to a front door of the housing and mated to the entry end of the peripheral component, the bezel being adapted to shift relative to the front door of the housing so as to properly mate to the entry end of the peripheral component as the front door is closed, wherein the bezel defines an interior space, the mating between the peripheral component and the bezel including the entry end of the peripheral component penetrating the interior space of the bezel.

2. The arrangement of claim 1, further including means for floatably mounting the bezel to the front door of the housing.

3. The arrangement of claim 2, wherein the mounting means permits the bezel to shift relative to the front door of the housing by approximately one-eighth inch in any direction from an unshifted center position.

4. The arrangement of claim 1, wherein the bezel includes a first aperture and the front door of the housing includes a second aperture, the second aperture being generally in line with and smaller than the first aperture, the bezel being connected to the front door of the housing by a fastener extending through the first aperture and fixed within the second aperture.

5. The arrangement of claim 4, wherein the first aperture is sufficiently larger than the fastener to allow the bezel to shift relative to the fastener.

6. The arrangement of claim 1, wherein the bezel includes a pair of first apertures and the front door of the housing includes a respective pair of second apertures, the pair of second apertures being generally in line with and smaller than the respective first apertures, the bezel being connected to the front door of the housing by a pair of fasteners extending through the respective first apertures and fixed within the respective second apertures.

7. The arrangement of claim 6, wherein the pair of first apertures are sufficiently larger than the respective fasteners to allow the bezel to shift relative to the fasteners.

8. The arrangement of claim 1, wherein the bezel includes a transmissive window aligned with and revealing a visual indicator on the entry end of the peripheral component.

9. The arrangement of claim 1, wherein the peripheral component is a bill acceptor.

10. A floating bezel assembly for a gaming machine, the gaming machine including a housing and a peripheral component mounted within the housing, the floating bezel assembly comprising:

a bezel defining an interior space and extending between a front door of the housing and an entry end of the peripheral component, the bezel being mated to the entry end wherein the mating includes the entry end extending into the interior space; and means for floatably mounting the bezel to the front door of the housing, the mounting means permitting the bezel to shift relative to the front door of the housing so as to properly mate to the entry end of the peripheral component as the front door is closed.

11. The assembly of claim 10, wherein the mounting means permits the bezel to shift relative to the front door of the housing by approximately one-eighth inch in any direction from an unshifted center position.

12. The assembly of claim 10, wherein the mounting means includes a first aperture in the bezel, a second aperture in the front door of the housing, and a fastener extending through the first aperture and fixed within the second aperture, the second aperture being generally in line with and smaller than the first aperture, the bezel being connected to the front door of the housing by the fastener.

13. The assembly of claim 12, wherein the first aperture is sufficiently larger than the fastener to allow the bezel to shift relative to the fastener.

14. The assembly of claim 10, wherein the mounting means includes a pair of first apertures in the bezel, a pair of second apertures in the front door of the housing, and a pair of fasteners extending through the respective first apertures and fixed within the respective second apertures, the pair of second apertures being generally in line with and smaller than the respective first apertures, the bezel being connected to the front door of the housing by the pair of fasteners.

15. The assembly of claim 14, wherein the pair of first apertures are sufficiently larger than the respective fasteners to allow the bezel to shift relative to the fasteners.

16. The assembly of claim 10, wherein the bezel includes a transmissive window aligned with and revealing a visual indicator on the entry end of the peripheral component.

17. A method of making a peripheral component arrangement for a gaming machine, the gaming machine including a housing, the method comprising:

mounting a peripheral component within the housing, the peripheral component including an entry end with an entry slot;

floatably mounting a bezel to a front door of the housing so that the bezel can shift relative to the front door of the housing, the bezel defining an interior space; and aligning and mating the bezel to the entry end of the peripheral component as the front door is closed, wherein the mating includes the entry end of the peripheral component entering the interior space of the bezel.

18. The method of claim 17, wherein the step of floatably mounting a bezel includes mounting the bezel to the front door of the housing with one or more fasteners extending loosely through the bezel and fitting snugly within the front door of the housing.

19. The method of claim 17, wherein the step of floatably mounting a bezel permits the bezel to shift relative to the front door of the housing by approximately one-eighth inch in any direction from an unshifted center position.

20. The method of claim 17, wherein shift of the bezel relative to the front door of the housing includes shifting along a plane that is approximately parallel to a plane defined by the front door.

21. The method of claim 17 wherein shift of the bezel relative to the front door of the housing includes shifting lateral to a plane defined by the front door.

22. The method of claim 17, wherein the peripheral component is a card reader.

* * * * *